United States Patent [19]

Van Heijst et al.

[11] 4,406,636

[45] Sep. 27, 1983

[54] SINGLE-POINT MOORING SYSTEMS

[76] Inventors: Willem J. Van Heijst, 34 Rue de Fauceguy, Annemasse, France; Urias G. Nooteboom, Laan van Meerdervoort 30f, The Hague, Netherlands

[21] Appl. No.: 317,868

[22] Filed: Nov. 3, 1981

Related U.S. Application Data

[63] Continuation of Ser. No. 92,931, Nov. 9, 1979, abandoned.

[30] Foreign Application Priority Data

Nov. 14, 1978 [GB] United Kingdom ..... 44435/78

[51] Int. Cl.[3] ..... B63B 21/52

[52] U.S. Cl. ..... 441/5; 114/230

[58] Field of Search ..... 114/230, 250; 441/3-5; 280/460 R, 495

[56] References Cited

U.S. PATENT DOCUMENTS

| | | | |
|---|---|---|---|
| 2,370,866 | 3/1945 | Lewis | 280/460 R X |
| 2,604,866 | 7/1952 | Alcorn | 441/3 X |
| 2,715,314 | 8/1955 | Smith | 114/230 X |
| 2,882,536 | 4/1959 | Jordan | 9/8 P |
| 3,086,367 | 8/1963 | Foster | 9/8 P |
| 3,366,982 | 2/1968 | Sutton | 9/8 P |
| 3,380,091 | 4/1968 | Saurin et al. | 9/8 P |
| 3,442,245 | 5/1969 | Christians et al. | 114/230 |
| 3,620,181 | 11/1971 | Naczkowski | 9/8 P |
| 3,636,908 | 1/1972 | Feldman et al. | 114/230 |
| 3,774,253 | 11/1973 | Lecomte | 9/8 P |
| 4,098,212 | 7/1978 | Kemper et al. | 9/8 P |
| 4,148,107 | 4/1979 | Karl et al. | 9/8 P |

FOREIGN PATENT DOCUMENTS

| | | | |
|---|---|---|---|
| 1231119 | 12/1966 | Fed. Rep. of Germany | 280/460 |
| 1014879 | 12/1965 | United Kingdom . | |
| 1104561 | 2/1968 | United Kingdom . | |
| 1129935 | 10/1968 | United Kingdom . | |
| 1189758 | 4/1970 | United Kingdom . | |
| 1194371 | 6/1970 | United Kingdom . | |
| 1357997 | 6/1974 | United Kingdom . | |
| 1384983 | 2/1975 | United Kingdom . | |
| 1527887 | 10/1978 | United Kingdom | 9/8 P |

*Primary Examiner*—Sherman D. Basinger

*Attorney, Agent, or Firm*—Arnold, White & Durkee

[57] ABSTRACT

A permanent single-point mooring arrangement for a floating unit comprises a buoy anchored to the seabed with anchor points and catenary shaped anchor lines, which are connected to a central shaft located in the buoy around which the buoy—and the floating unit moored to the buoy—can rotate in a horizontal plane, a yoke for attaching the floating unit to the buoy being such that the floating unit may also move in a vertical plane so as to accommodate the relative motion between the buoy and the floating unit caused by wave action and loading conditions of the floating unit, the attachment for the floating unit being formed of a rigid connecting yoke which is attached at one end to the buoy and at the other to the floating unit and the attachment also comprising flexible joints associated with the rigid yoke, two radial and one axial flexible joint permitting a horizontal hinge motion between the buoy and the yoke at one side and between the yoke and the floating unit at the other, and is characterized in that the buoy is of rectangular shape the length of which is considerably greater than its width and that the catenary shaped anchor chains are connected to a central shaft the diameter of which is small with respect to the width of the buoy.

15 Claims, 11 Drawing Figures

SINGLE-POINT MOORING SYSTEMSThis is a continuation of application, Ser. No. 92,931, filed Nov. 9, 1979, now abandoned.

The present invention relates to a permanent single-point mooring arrangement for a floating unit which comprises a buoy anchored to the sea-bed with anchor points and catenary shaped anchor lines which are connected to a central shaft located in the buoy around which the buoy—and the floating unit moored to the buoy—can rotate in a horizontal plane, the means for attaching the floating unit to the buoy being such that the floating unit may also move in a vertical plane so as to accommodate the relative motion between the buoy and the floating unit caused by wave action and loading condition of the floating unit, said floating unit attaching means being formed of a rigid connecting yoke which is attached at one end to the buoy and at the other to the floating unit, and said floating unit attaching means also comprising flexible joints associated with the rigid yoke, two radial and one axial flexible joints allowing only for a horizontal hinge motion between buoy and yoke at one side and between yoke and floating unit at the other side of the yoke.

The problem of creating a permanent mooring for large vessels on full sea is that a vessel or other floating unit must have the ability to rotate about a vertical axis of the buoy and must at the same time have the ability to conduct various motions caused by wave slamming, wind and tide streams.

The means for the attachment of the floating unit to the buoy comprise a rigid yoke or system of rigid arms so that the distance between the floating unit and the buoy can be kept constant. On the other hand there should be included a certain flexibility in the connection between the said parts.

Various systems have been developed in recent years, none of which, however, being able to solve the problem in a completely satisfying way. For example in an existant mooring construction with catenary anchoring of the buoy a hinge connection is provided between the ship and the rigid arm. The other end of the rigid arm is coupled with the buoy through a radial, axial bearing, permitting rotation about the vertical axis, but no pivoting movement about a horizontal axis. Further the chain lines of the catenary system have been fixed to the circumference of the buoy. Such system is known from Dutch patent application Nr. 72/12998 (S.B.M.) published Mar. 18, 1974.

In another existant mooring construction—U.S. Pat. No. 3,380,091 (B.P.) the rigid yoke is connected in a flexible way both to the floating unit and to the buoy. The buoy, however, itself is connected by tight, vertically tensioned anchor chains to a anchoring foundation plate. This construction, however, does not lend itself for arrangement in a body of water with great differences between low tide and high tide.

In these known constructions the buoy concerned, has a cylindrical shape.

The invention has for its object to improve the existant constructions and to eliminate the inherent disadvantages. According to the invention the buoy has a rectangular shape of which the length is considerably larger than the width and whereby the catenary shaped anchor chains are connected to a central shaft whose diameter size is small with respect to the width dimension of the buoy. By this construction the roll stability is decreased so that the present mooring construction can follow more dynamically any rolling movement.

In a preferred embodiment the mooring arrangement according to the invention comprises a rectangular buoy with inclined or curve shaped side hull plating which minimizes the roll stability of the buoy. The cross-section of the buoy can even be semi-circular causing the roll-stability to approach virtually zero.

In another, likewise preferred embodiment the device according to the invention is constructed such that the means for flexible attachment of the yoke to the buoy are located above the water line at the short side of the rectangular buoy near deck level.

It is advantageous if the central shaft is placed excentric from the central axis of the buoy. In that case a certain upward or downward pressure of the rigid yoke can be compensated for.

In this connection another feature is worth mentioning, viz. that the yoke comprises a buoyancy tank which is permanently or temporarily connected to said yoke to eliminate the vertical loading of the buoy by the weight of the yoke. The additional buoyancy tank is used to mount and connect the vessel and rigid arm to the previously installed mooring buoy. Due to the buoyancy of this additional tank, the yoke can be brought in the correct position with respect to the buoy. When the assembly has terminated, the buoyancy tank can be removed, if desired, since an upward pressure is no longer needed.

Accordingly a mooring system is obtained having a low roll resistance about the X—X axis, that means a greater instability, a high resistance against torsion and a high tipping resistance.

The performance is due to the fact that the buoy has a rectangular shape; the buoy-yoke-floating unit is hinged at two places; the coupling between yoke and buoy is provided at a side of the buoy above the waterline; the distance between the fixation places of the catenary chains is small.

The location of the hinges between yoke and buoy is very important; the location chosen is the best one in view of tipping of the buoy; the under buoy hoses are free suspended, really vertically without being clamped in a tilted position at the suspension point.

The invention will be explained further by reference to the figures of the drawings, in which FIG. 1 shows a general view in perspective of a single-point mooring system according to the invention;

Figure 1:
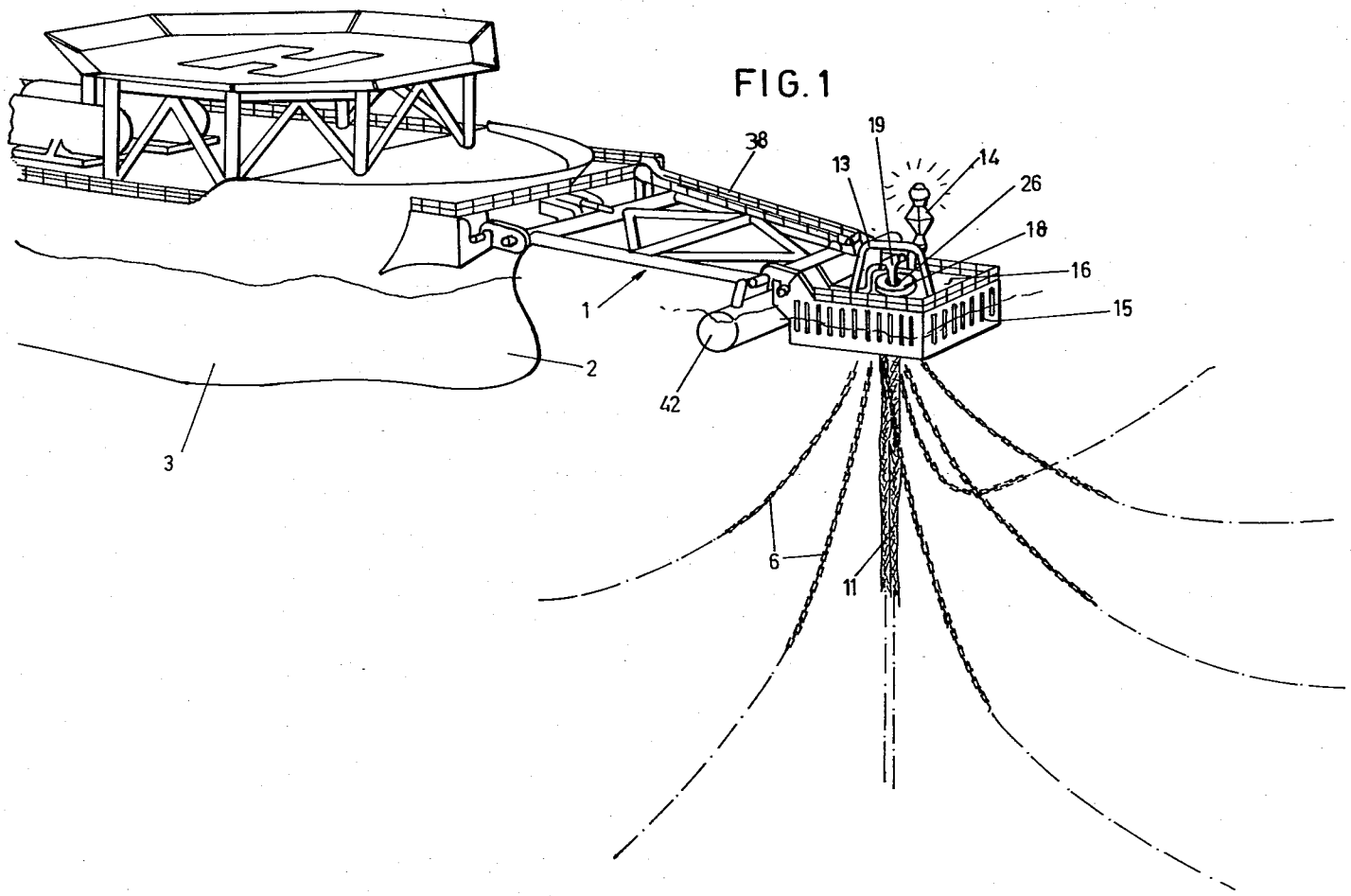
Figure 2:
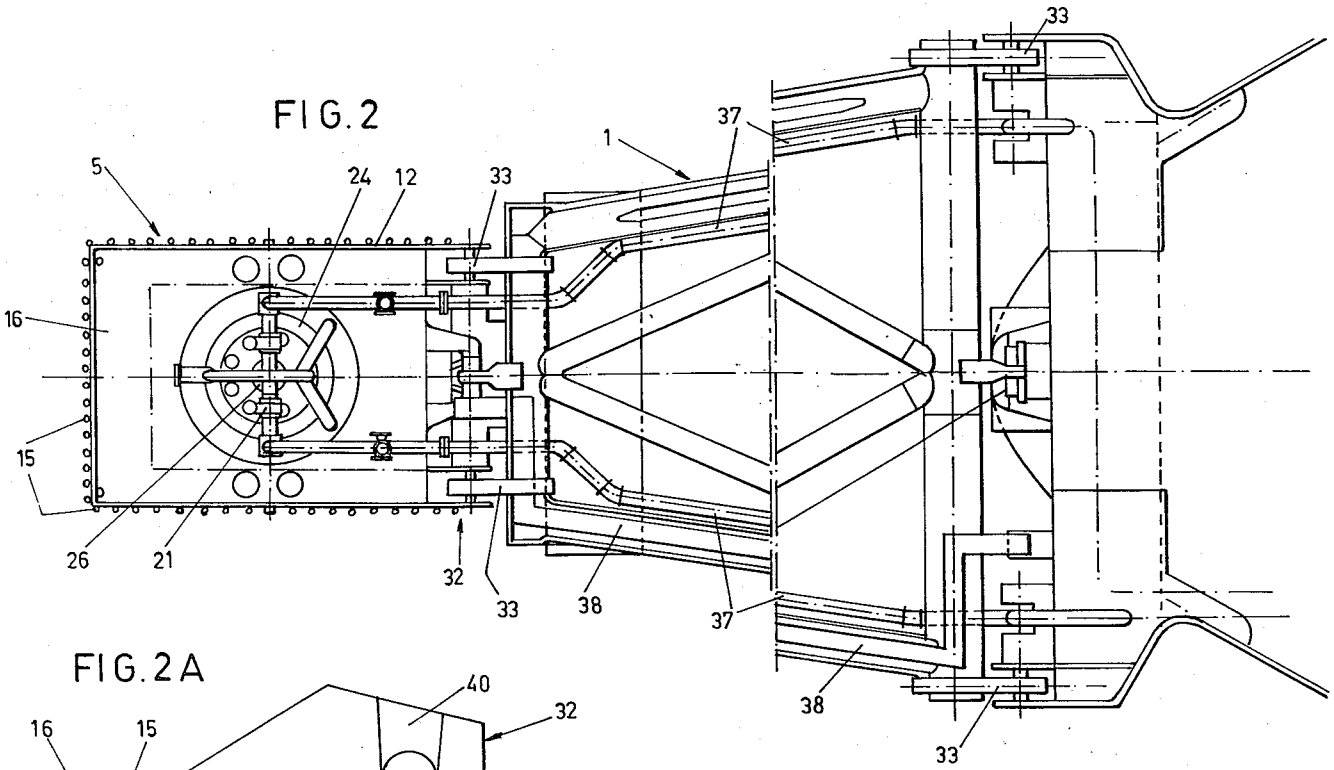
FIG. 2 shows a plan view of the inventive mooring system.
Figure 2A:
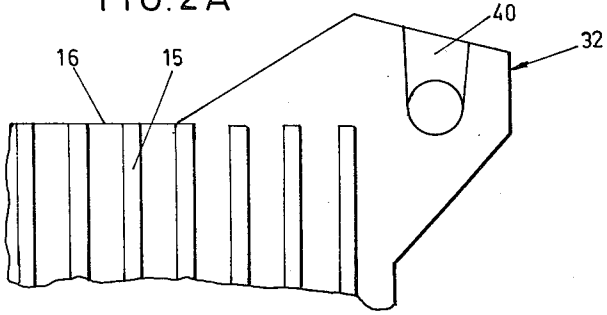
FIG. 2A is a detail of the hinge construction between buoy and yoke.
Figures 3, 3A:
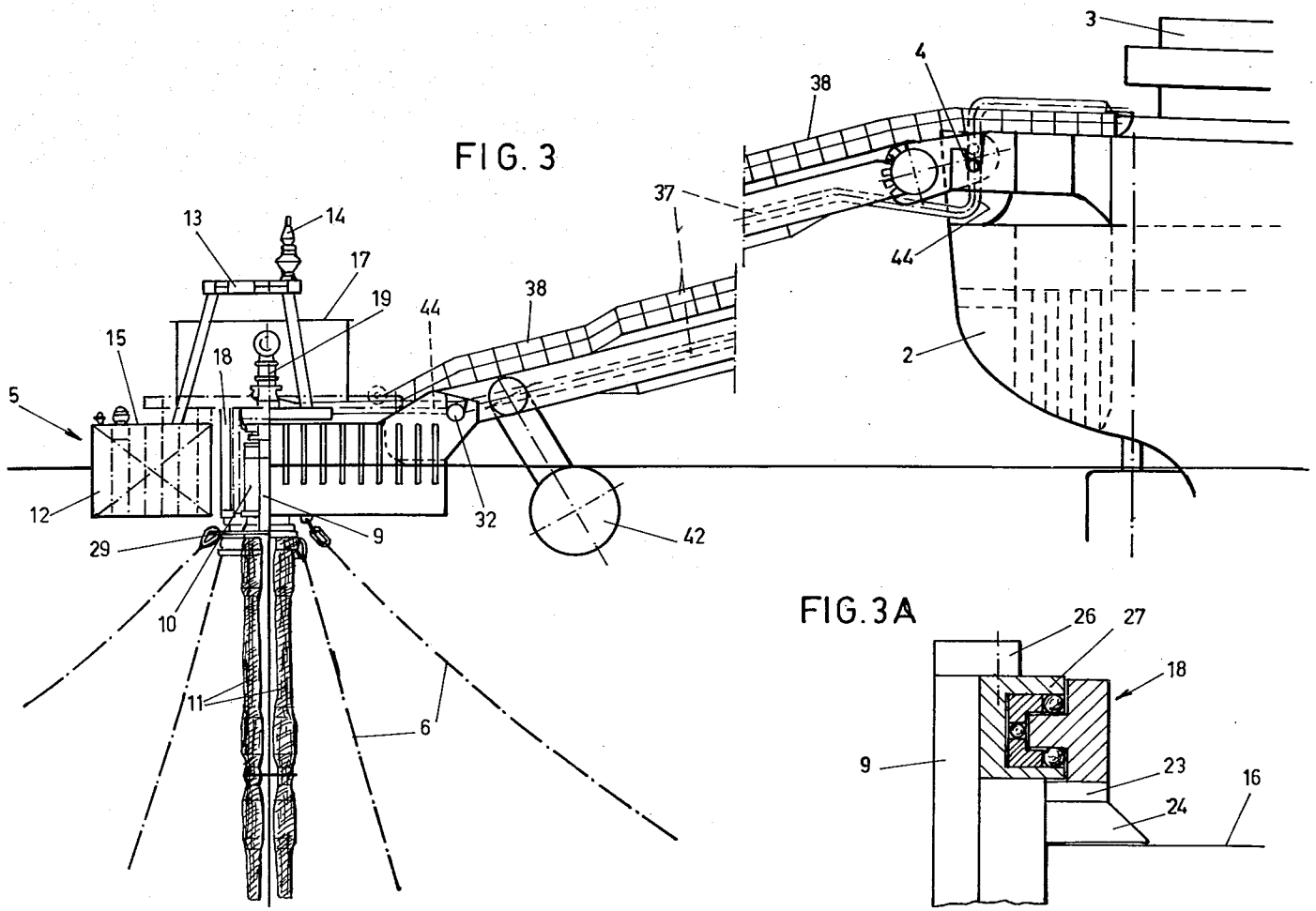
FIG. 3 shows a side elevational view of the inventive mooring system.
FIG. 3A is a detail of the bearing construction used in FIG. 3.
Figure 4:
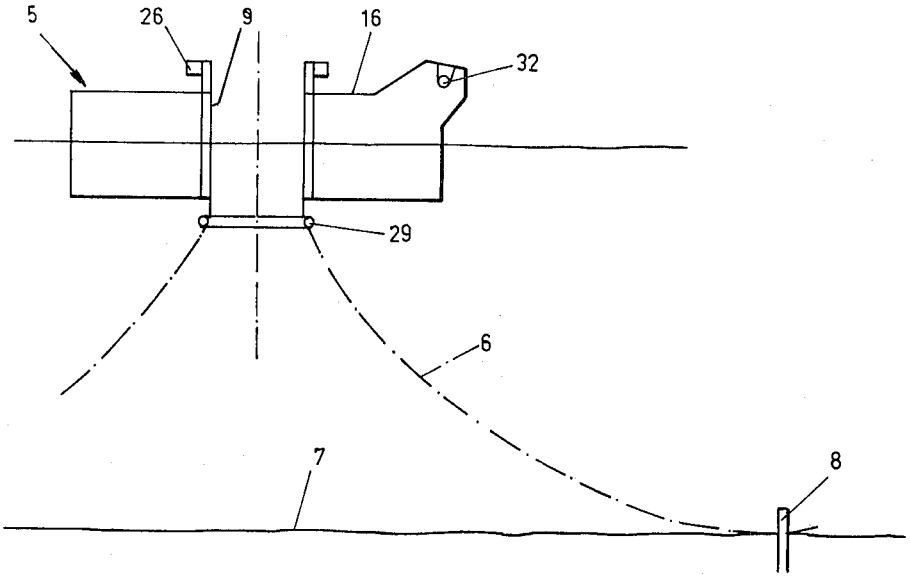
FIG. 4 shows a simplified embodiment of the rectangular buoy applied in the embodiment of FIG. 2 and 3.

The single-point mooring system according to the invention is shown in FIG. 1, 2 and 3, viz. in perspective, in plan view and in side view respectively, of which a simplified version is shown in FIG. 4 and some details further have been amplified in FIG. 2A and 3A.

The Rigid Arm CALM System according to the invention resembles other fleating CALM type storage systems in most aspects. A rigid arm 1 is connected to the bow or the stern 2 of the storage vessel 3 by maintenance-free bearings 4 allowing the vessel to pitch relative to the rigid arm 1 and the buoy 5. Anchor chains 6, piled to the sea-bed 7 with anchor points 8, are used to hold the buoy in position. (FIG. 4).

The chains 6 are connected to the centre of the buoy at the bottom of a central shaft 9. The central shaft also contains the piping 10 for mating with the under buoy hoses 11. The buoy body 12 has a rectangular shape and consists of a simple, cost efficient box construction subdivided into water tight compartments. On a high scaffolding 13 the buoy carries a light beacon 14, FIGS. 1 and 3, for example a flashing light. Three sides of the buoy have fenders 15 consisting of vertical pipe sections welded directly to the buoy body 12. The deck 16 of the buoy is flat. A toolshed swivel room 17 is projected to cover the main mooring bearings 18, the fluid swivels 19 and the expansion joints 21 preventing water ingress in this area. The roller bearing 18 is fitted on a flange 23 (FIG. 3A) welded to the buoy deck 16 via a stiffened ring support 24. The central shaft 9 also has a flange 26 bolted to the inner ring 27 of the buoy bearing 18. Chains 6 are connected to the central shaft 9 via pivot links 29 eliminating excessive wear of the first link to the buoy.

The rigid arm is a tubular construction (see FIG. 2), and it is connected to the buoy body 12 with hinges 32–34. Laminated elastomeric bearings will be used for the actual hinges at each end 4 and 32 of the rigid arm 1. Radial and axial hinges 33, 34 are separated. The rigid arm is constructed according to the latest structural building codes and is designed to withstand all mooring forces, wave slamming forces and motion interaction forces between the buoy and the vessel. The rigid arm carries the product piping 37 and walkways 38 between the buoy 5 and the vessel 3.

The hinge connection 32 between the buoy 5 and the rigid arm 1 can also be used as an installation and release connection. Thereto, (see FIG. 2A) the hinge shafts 39 are locked (40) in a hook type support 41 at the buoy deck 16. The rigid arm is supported by a permanent buoyancy tank 42 located under the yoke 1 so that the buoy will not list under the weight of the yoke 1 and remains level when the yoke is disconnected. Hinges 32 between the buoy 5 and the arm 1 and between the arm and storage vessel 3 are jumped with a hose 44 for the fluid lines 37.

In most areas of the world, the most severe sea conditions are coming from a limited sector and not from all directions. This would allow for an anchoring system that is strong in the storm direction and less do, but still sufficiently strong, in other directions.

Such a "nonsymmetrical" chain layout results in an unequal vertical load on the buoy which would normally result in buoy tipping. It would be possible to adjust this by placing a large counterweight in the buoy. However, even a relative small mooring force disturbs this static equilibrium, so it is preferred to connect the chain 6 as closely as possible to the centre of the buoy reducing the influence of the variation in vertical load between the chains to a minimum. This also makes it possible to design a very compact buoy and load carrying structure.

In order to stabilize the buoy motions, the hinges are placed at the extremity of the buoy and as low as possible to the waterline to limit tipping movements of the buoy. If an ordinary SBM design with a turntable was to be chosen, then the turntable loading would be extremely high due to the tipping moments, and a rather heavy and complex structure would result. The solution seleced with a central load carrying structure to which the anchor chains are connected near the center and a rotating buoy body with hinge supports on the edge of the buoy results in a Single Point Mooring (SPM) that is simple, adequate and that can be used with or without a rigid arm.

Another important advantage of the selected design is that the buoy tipping motions are much smaller when the rigid arm 1 can hinge at the buoy intersection 32. Model tests have demonstrated that the buoy tipping angles are smaller than the rigid arm tipping angles. Moreover, the buoy does not list due to the loading condition of the tanker but always remains horizontal. This greatly increases the life expectancy of the first hose link 11 under the buoy.

Figure 5A:
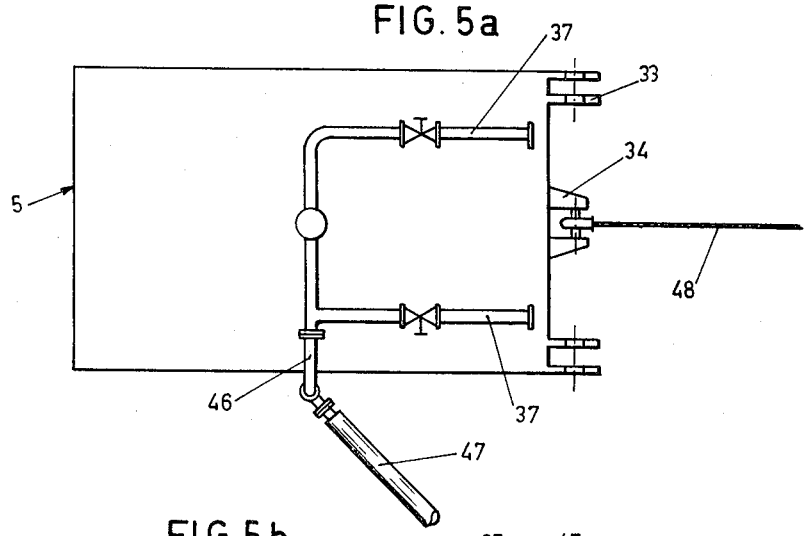
in FIG. 5*a* in plan view and in FIG. 5*b* in side elevational view.
Figure 5B:
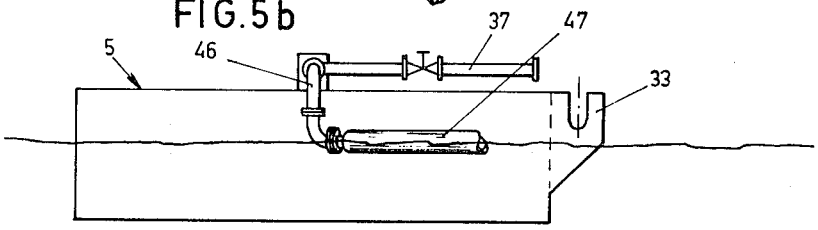
FIG. 5 illustrates a detail of the connection of the fluid lines between buoy and yoke.

The hook-up procedure is easiest when the location of the actual mating faces is chosen where structural demands are relatively low. The hinge 32 between the buoy and the rigid arm is such a place. So, the hinge 32 construction is combined with the installation and release connection. The arm incorporates a buoyancy tank 42 at the buoy end. With this tank 42, the arm 1 itself floats above the water surface when only attached to the tanker 3. This configuration is safe in almost all sea conditions. The height of the rigid arm 1 end above the water is sufficient to make the connection with the buoy 5 without additional lifting equipment. When the release of the tanker 3 is required, the arm 1 can also be disconnected without the help of special offshore lifting equipment. This makes the design extremely flexible for operational purposes. If the tanker 3 has to released for repair or overhaul purposes, a suitable SPM system will remain available (FIG. 5). The only modification required is the fitting of the overboard piping 46, the floating hoses 47, and the mooring hawsers 48. The mooring hawsers are attached to the axial hinge bearing support 34 on the buoy 5.

Figure 6A:
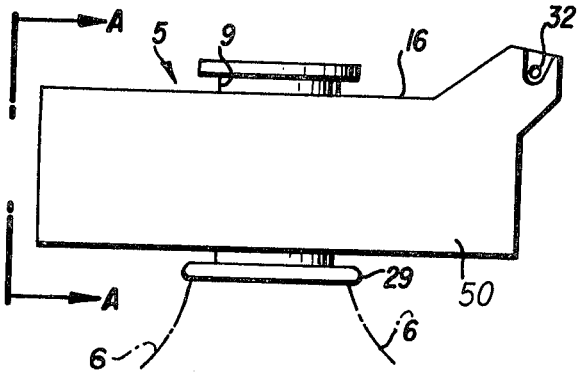
FIG. 6A shows a side elevational view of an alternative embodiment of a buoy in accordance with this invention.
Figure 6B:
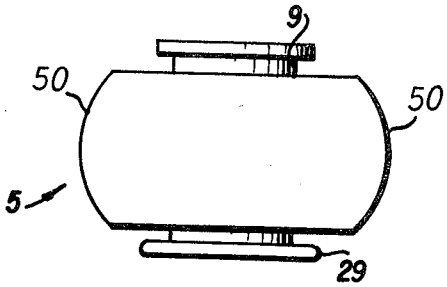
FIG. 6B shows an end elevation of the buoy of FIG. 6A.

With particular reference to FIGS. 6A and 6B, in this embodiment the buoy 5 is a rectangular buoy which has inclined or curved shaped side hull plating 50 for minimizing the roll stability of the buoy 5.

Figure 6C:
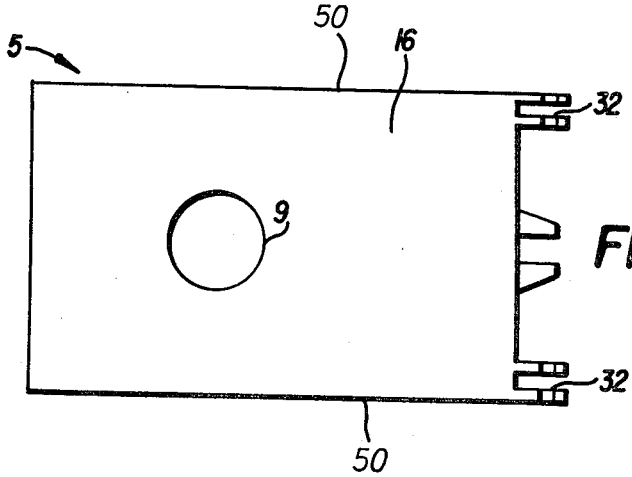
FIG. 6C shows a plan view of yet a further alternative embodiment of a buoy in accordance with this invention.

With particular reference to FIG. 6C of the drawings, the buoy 5 of that illustrated embodiment has the central shaft 9 placed eccentrically from the central axis of the buoy 5.

We claim:

1. A permanent single-point mooring arrangement for a floating unit which comprises a buoy (5) anchored to the sea-bed (7) with anchor points (8) and catenary shaped anchor lines (6), which are connected to a central shaft (9) located in the buoy (5) around which the buoy—and a floating unit (3) moored to the buoy—can rotate in a horizontal plane, the means for attaching the floating unit to the buoy being such that the floating unit may also move in a vertical plane so as to accommodate relative motion between the buoy and the floating unit, said floating unit attaching means being formed of a rigid connecting yoke (1) which is attached at one end to the buoy and at the other to the floating unit and said floating unit attaching means also comprising flexible joints (32–34) associated with the rigid yoke, two lateral (33) and one axial (34) flexible joints allowing for a horizontal hinge motion between buoy and yoke at one side and between yoke and floating unit at the other side of the yoke, the buoy (5) having a rectangular shape of which the length is considerably larger than its width and whereby the catenary shaped anchor chains (6) are connected to the central shaft (9) whose diameter size is small with respect to the width dimension of the buoy (5), and the flexible attachment means being located above the water line along one short side constituting the width of the rectangular buoy near deck level.

2. A single point mooring arrangement to be anchored to a sea-bed by means of catenary shaped anchor lines for forming a permanent mooring arrangement for the mooring of a floating unit, the mooring arrangement comprising:

(a) buoy which is rectangular having a length substantially larger than its width;

(b) a central shaft rotably located in the buoy for the buoy to rotate about the central shaft in a horizontal plane during use, the central shaft having a diameter which is small in relation to the width of the buoy, and the central shaft having anchor points for receiving catenary anchor lines to anchor the central shaft to a sea-bed during use;

(c) the buoy having a plurality of hinge attachment joint members for engaging with hinge members of a rigid yoke to attach such a yoke and thus a floating unit connected to the yoke to the mooring arrangement, the hinge attachment joint members defining a horizontal pivot axis about which a yoke connected to the buoy can pivot relatively to the buoy, the attachment joint members being provided along one short side of the buoy to define the horizontal pivot axis along the edge of the buoy to reduce tipping motions of the buoy during use when the attachment joint members of the buoy are engaged with hinge members of such a rigid yoke, and the hinge attachment joint members being laterally spaced along the short side to improve stability between such a yoke and the buoy during use.

3. A mooring arrangement according to claim 2, in which the hinge attachment joint members are provided on the buoy to be located above water level and proximate the upper surface of the buoy during use.

4. A mooring arrangement according to claim 2, in which the hinge attachment joint members are fastened to extend outwardly beyond the short side of the buoy to define the horizontal pivot axis beyond the periphery of the short side of the buoy.

5. A mooring arrangement according to any one of claims 2 to 4, in which each hinge attachment joint member is in the form of a hook type support for pivotally receiving a hinge shaft of a hinge member of a rigid yoke.

6. A mooring arrangement according to claim 5, in which each hook type support is directed upwardly for a hinge shaft to be vertically displaceable for engaging with the support to form a pivotal connection.

7. A mooring arrangement according to claim 2, including a rigid yoke for mooring a floating unit to the buoy, the rigid yoke having hinge members for engaging with the hinge attachment joint members to pivotally connect the yoke to the buoy.

8. A mooring arrangement according to claim 7, including anchor lines which are connected to the central shaft and which include anchor points for anchoring the anchor lines on a sea-bed for the anchor lines to be catenary shaped.

9. A mooring arrangement according to claim 8, which is anchored to the sea-bed by means of the anchor points and anchor lines, and which includes a floating unit moored thereto by being hingedly connected to the rigid yoke to permit relative vertical motion between the floating unit and the yoke.

10. A single point mooring arrangement according to claim 9, which comprises one or more pipe lines for the transference of fluid which comprises a link pipeline system which connects a pipeline system of the floating unit to a pipeline terminal of the buoy, the link pipeline system comprising one or more flexible hoses which are supported on and protected by the rigid yoke.

11. A single point mooring arrangement according to claim 7, in which the yoke includes a buoyancy tank which is permanently or temporarily connected to said yoke to eliminate vertical loading of the buoy by the weight of the yoke.

12. A single point mooring arrangement according to claim 2, in which a housing is provided over the central shaft.

13. A single point mooring arrangement according to claim 2, in which the buoy has inclined or curve shaped side hull plating for minimizing the roll stability of the buoy.

14. A single point mooring arrangement according to claim 2, in which the central shaft is positioned eccentrically from the central axis of the buoy to balance the effects of such a yoke when attached thereto.

15. A single point mooring arrangement to be anchored to a sea-bed by means of catenary shaped anchor lines for forming a permanent mooring arrangement for the mooring of a floating unit, the mooring arrangement comprising:

(a) a buoy which is rectangular having a length substantially larger than its width;

(b) a central shaft rotably located in the buoy for the buoy to rotate about the central shaft in a horizontal plane during use, the central shaft having a diameter which is small in relation to the width of the buoy, and the central shaft having anchor points for receiving catenary anchor lines to anchor the central shaft to a sea-bed during use;

(c) the buoy having a plurality of hinge attachment joints for engaging with attachment joints of a rigid yoke to form a hinge connection with such a yoke, the hinge attachment joints being adapted to engage with such a rigid yoke to form a hinge which permits relative displacement about a horizontal axis only, the attachment joints being provided along one short side of the buoy to reduce tipping motions of the buoy during use when engaged with such rigid yoke, and the attachment joints being laterally spaced along the short side to improve stability between such a yoke and the buoy during use.

* * * * *